United States Patent [19]

Chihara et al.

[11] 4,435,089

[45] Mar. 6, 1984

[54] POWER CIRCUIT FOR AN ELECTRONIC TIMEPIECE

[75] Inventors: Hiroyuki Chihara, Suwa; Masuo Kitano, Matsumoto, both of Japan

[73] Assignees: Kabushiki Kaisha Suwa Seikosha, Tokyo; Shimauchi Seiki Kabushiki Kaisha, Nagano, both of Japan

[21] Appl. No.: 378,947

[22] Filed: May 17, 1982

[30] Foreign Application Priority Data

May 18, 1981 [JP] Japan ..... 56-74535

[51] Int. Cl.[3] ..... G04C 10/00

[52] U.S. Cl. ..... 368/204; 307/12

[58] Field of Search ..... 307/12, 19, 29; 368/203, 204

[56] References Cited

U.S. PATENT DOCUMENTS

| | | | |
|---|---|---|---|
| 4,308,609 | 12/1981 | Tamaki | 368/204 |
| 4,328,570 | 5/1982 | Nakagawa | 368/204 X |
| 4,395,138 | 7/1983 | Chihara | 368/204 |
| 4,404,624 | 9/1983 | Yamazaki | 368/204 X |

FOREIGN PATENT DOCUMENTS

| | | | |
|---|---|---|---|
| 56-79984 | 6/1981 | Japan | 368/204 |
| 57-52881 | 3/1982 | Japan | 368/204 |
| 1574870 | 9/1980 | United Kingdom | 368/204 |

*Primary Examiner*—William M. Shoop

*Attorney, Agent, or Firm*—Blum, Kaplan, Friedman, Silberman and Beran

[57] ABSTRACT

A timepiece includes in addition to the conventional timekeeping circuits, high load, that is, high current circuits such as an alarm driving circuit and a lamp driving circuit. Low load, small current systems such as the oscillator, divider, display drivers and display for timekeeping are operated directly from the battery voltage source when the high load circuits are off. When the high load circuits are on, the low load circuits are disconnected from the battery and operate from an electric charge stored in a capacitor connected in parallel with the low load circuits. The high load circuits are driven intermittently at a high frequency to reduce power consumption and to permit recharging of the storage capacitor during off-periods. The drive frequency is sufficiently high such that an illumination lamp shows no flicker and brightness is controlled by duty cycle.

10 Claims, 7 Drawing Figures

POWER CIRCUIT FOR AN ELECTRONIC TIMEPIECE

BACKGROUND OF THE INVENTION

This invention relates generally to an electronic timepiece operated on an internal battery and more particularly to a power circuit for a small thin electronic timepiece which operates reliably on a small battery. All circuits of a conventional electronic timepiece, such as the oscillator circuit, divider, display, alarm driving circuit and lamp driving circuit are connected simultaneously to the same power circuit for an electronic timepiece. When lighting the illumination lamp or driving the alarm circuit, especially at low temperature, battery voltage drops and failure of oscillation or erroneous circuit operation may result. For example, the count in the divider may become inaccurate. This reduced battery voltage can cause the timepiece to stop or their may be loss in time as displayed. To eliminate these defects in prior art timepieces having either or both an illumination lamp and an alarm, a large-sized and thick battery, having a low internal resistance, has been used. Accordingly, it has not been possible to provide a thin electronic timepiece with either or both an illumination lamp and an alarm.

What is needed is a power circuit for an electronic timepiece which provides reliable timekeeping operation in a thin electronic timepiece having either or both an illumination lamp and an alarm.

SUMMARY OF THE INVENTION

Generally speaking, in accordance with the invention, a power circuit for an electronic timepiece especially suitable for a small thin electronic timepiece having either or both an illumination lamp and alarm function, is provided. The timepiece includes in addition to the conventional timekeeping circuits, high load, that is, high current circuits such as an alarm driving circuit and a lamp driving circuit. The low load, small current systems such as the oscillator, divider, display drivers and display for the electronic timepiece are operated directly from the battery voltage source when the high load circuits are off. When the high load circuits are on, the low load circuits, that is, timekeeping circuits are disconnected from the battery and operate from an electric charge stored in a capacitor connected in parallel with the low load circuits. The high load circuits are driven intermittently at a high frequency to reduce power consumption and to permit recharging of the storage capacitor during off-periods. The frequency is sufficiently high such that an illumination lamp shows no flicker and brightness is controlled by duty cycle.

Accordingly, it is an object of this invention to provide an improved power circuit for an electronic timepiece so as to provide reliable timekeeping in a small-thin timepiece including high load circuits such as illumination and alarm.

Another object of this invention is to provide an improved power circuit for an electronic timepiece which permits the timekeeping circuits to operate independently of the battery voltage source during periods when high loads are operatively connected to the battery.

Still another object of this invention is provide an improved power circuit for an electronic timepiece which operates timekeeping circuits from a charged capacitor while heavy load circuits operate from an internal battery.

Yet another object of this invention is to provide an improved power circuit for an electronic timepiece wherein timekeeping circuits are operated from a charged capacitor while heavy load circuits are operative on the internal battery, the heavy load operating at a repetition rate permitting recharging of the capacitor.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which.

DESCRIPTION OF THE PREFERRED EMBODIMENTS

The power circuit for an electronic timepiece in accordance with the invention is for a timepiece having circuits including an illumination lamp driving circuit and a speaker driving circuit. The lamp and speaker circuits when operating, draw a large current from the power supply. The timepiece also includes an oscillator, frequency divider, and display circuits for timekeeping which draw a very small current, especially in comparison to the current drawn by the illumination lamp and speaker driver circuits. However, the high currents flow only intermittently, and while the high load circuits are active, the low load-low current circuits are detached from the battery as explained more fully hereinafter.

Figure 1:
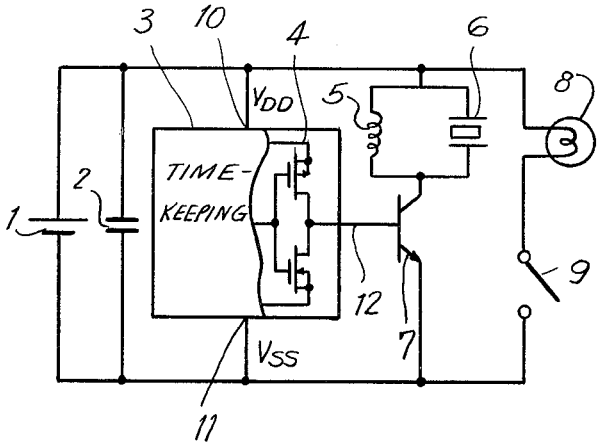
FIG. 1 is a circuit diagram for an electronic timepiece of the prior art having an illumination lamp and piezoelectric speaker.

With reference to FIG. 1, a circuit for an electronic timepiece of the prior art including a lamp and a piezoelectric speaker comprises a power battery 1, located internally, power capacitor 2, electronic circuit 3 for timekeeping including an oscillator, frequency divider, display driver, and a display (all not shown), a driver 4 for operating a piezoelectric electric speaker 6, a booster coil 5 associated with the piezoelectric speaker 6, and a transistor 7 for driving the piezoelectric speaker. The electronic timepiece also includes a lamp 8, lamp switch 9, battery terminal 10 ($V_{DD}$), battery terminal 11 ($V_{SS}$) and a speaker output terminal 12.

The electronic circuit 3, power capacitor 2, speaker circuit 5, 6, 7 and lamp circuit 8, 9 are connected directly across the terminals 10, 11 of the battery 1. A large current flows from the battery for lighting the illumination lamp 8 or driving the piezoelectric element 6. When a large current flows, the output voltage of the battery 1 drops due to the internal battery resistance. The voltage drop is especially significant at low temperatures and also for small, thin batteries and timepieces. If the battery voltage falls below an operating voltage for the timekeeping circuit 3, oscillation stoppage or faulty operation of the circuit may result.

Figure 2:
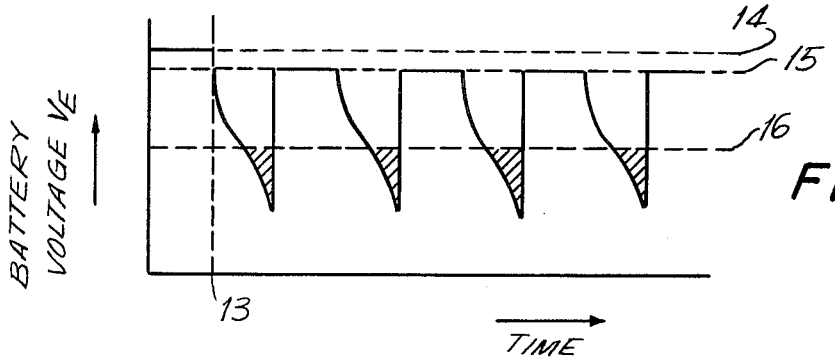
FIG. 2 is a graph of fluctuations in battery voltage when the piezoelectric speaker of FIG. 1 is driven.

FIG. 2 is a graph having the battery voltage Ve as an ordinate and time as the abscissa. The curve indicates battery voltage fluctuation when the piezoelectric speaker 6 is driven. In FIG. 2, the time 13 indicates when the speaker begins to be actuated. When current drain from the battery is low, the voltage is at a high level 14. The minimum operating voltage for the electronic circuit 3 of the timepiece is indicated at 16. When the speaker is actuated, the battery voltage drops below the level 16 as indicated by the shaded portion of the curve. The speaker is actuated intermittently such that when the speaker is de-energized momentarily the voltage level recovers substantially instantaneously to a level at 15, which is not a full, complete recovery after the high current is turned off, but does approach the level 14. Before complete recovery is achieved, the piezoelectric element 6 is actuated again and the voltage again falls below the acceptable level 16. The repetition rate of ON/OFF of the speaker 6 is selected to provide a desired sound quality for the speaker which may be used, for example, as an alarm sound. Because the battery voltage is below the operating voltage 16 of the electronic circuit 3, oscillation stoppage or faulty operation of the electronic circuit 3 for the timepiece generally will occur in those intervals indicated by the shaded portions of the curve below the level 16, especially at low temperatures.

Figure 3:
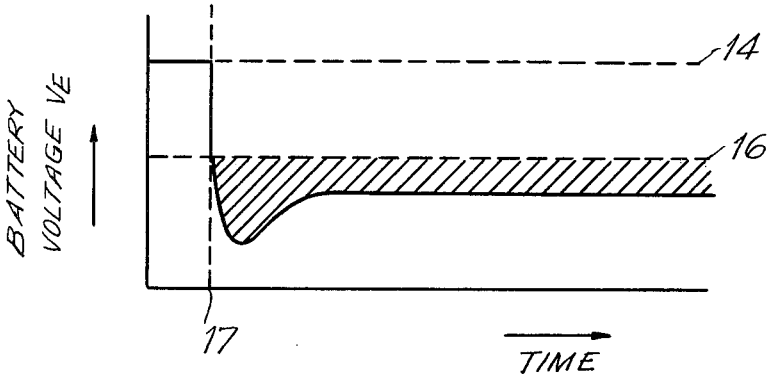
FIG. 3 is a graph of battery voltage when the illumination lamp of FIG. 1 is driven.

FIG. 3 is a graph representing battery voltage fluctuations when the illumination lamp 8 is driven. Illumination of the lamp 8 begins at the time 17. The voltage drops well below the level 16. Because the battery voltage is below the operating voltage 16 for the electronic circuit 3, oscillation stoppage or faulty operation of the electronic circuit 3 for the timepiece will likely occur in the shaded region. Therefore, the conventional battery for an electronic timepiece incorporating an illumination lamp and piezoelectric speaker must be comparatively large in size. However, circumstances are such that small and thin batteries are necessities to cope with requirements for miniaturization and thinness of a fashionable electronic timepiece.

Therefore, it is an object of this invention to eliminate the shortcomings described above, and to provide an electronic timepiece having an illumination lamp and piezoelectric speaker, which is free from faulty operation of the electronic circuitry for timekeeping and free from failure in oscillation of the crystal oscillator circuit even when lighting up an illumination lamp or driving the piezoelectric speaker at low temperatures. The timepiece in accordance with the invention has a small and thin battery and the timepiece likewise can be made in a fashionable design which is small and thin.

Figure 4:
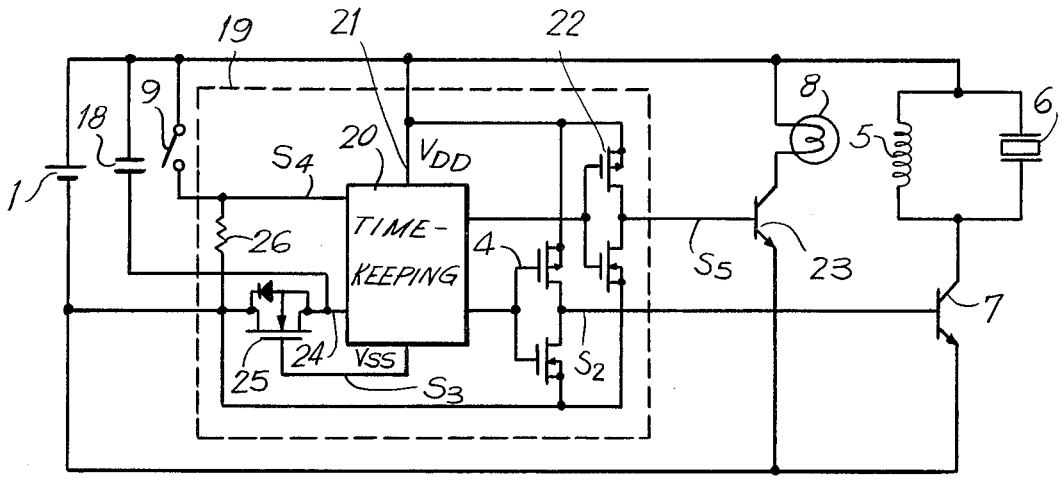
FIG. 4 is the power circuit for an electronic timepiece in accordance with the invention including an illumination lamp and piezoelectric speaker.

The power circuit for an electronic timepiece in accordance with the invention is now described with reference to FIG. 4, wherein the circuit diagram includes a power capacitor 18, a low current electronic circuit 20 for timekeeping including an oscillator, frequency divider and display (not shown), battery terminal 21 ($V_{DD}$), illumination lamp driver 22, and illumination lamp driving NPN transistor 23. Also identified in the Figure is a terminal 24 (Vss) for the low current electronic circuit 20 for timekeeping, a power switching N-channel transistor 25, and a pull-down resistance 26. Also identified in FIG. 4 are a piezoelectric speaker driving signal $S_2$, power switching signal $S_3$, lamp ON signal $S_4$, and illumination lamp driving signal $S_5$. The speaker circuitry 5, 6, 7 and the illumination lamp circuitry 8, 23 draw power directly from the power supply 1 when the associated switching transistors 7, 23, respectively are actuated to conduct.

Figure 5:
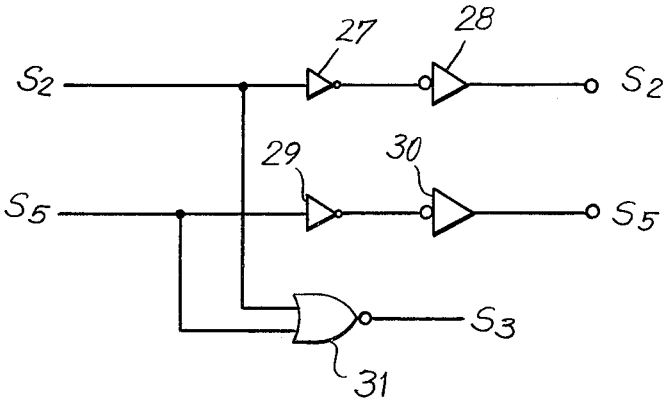
FIG. 5 is a circuit for producing a power switching signal for an illumination lamp and a piezoelectric speaker driving signal in the circuit of FIG. 4.

FIG. 5 illustrates a circuit producing a power switching signal $S_3$, the illumination lamp driving signal $S_5$, and the piezoelectric speaker driving signal $S_2$. The inverters 27 and 29 and inverters 28 and 30 are the same as the piezoelectric speaker driver 4 and the illumination lamp driver 22, respectively. The circuit also includes a NOR gate 31 for producing the power switching signal $S_3$.

Figure 6:
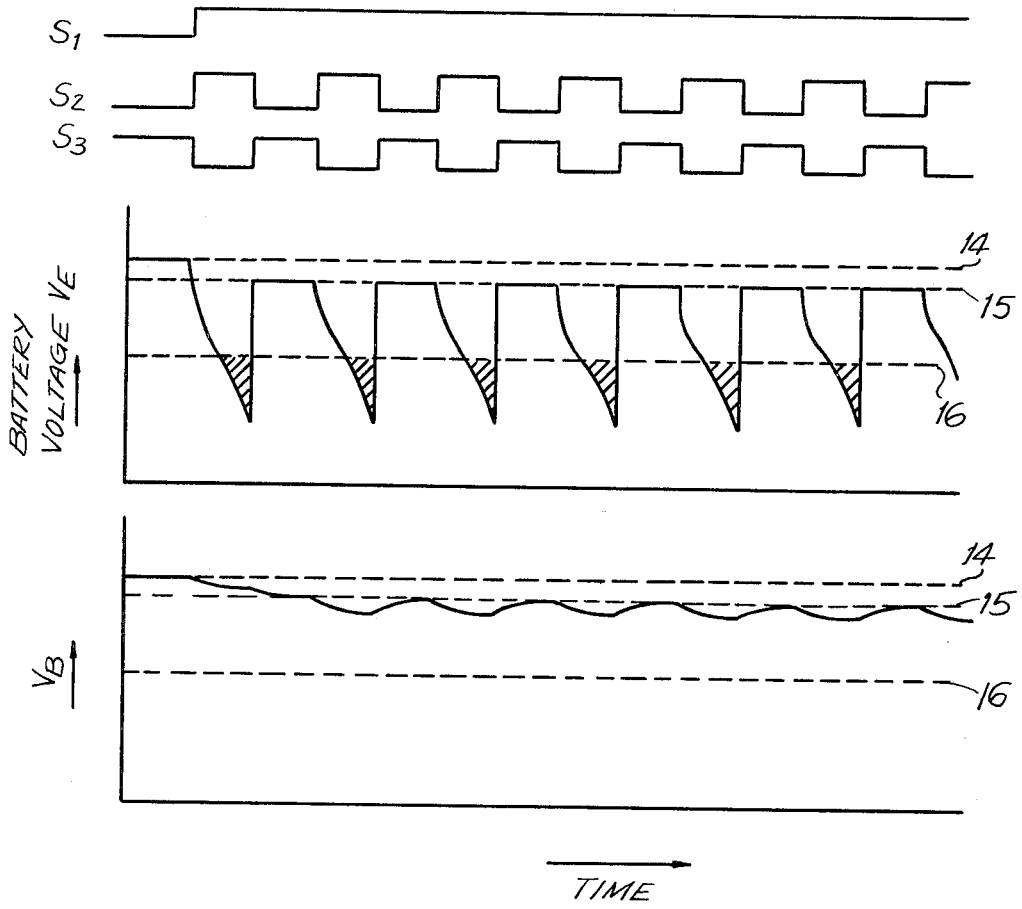
FIG. 6 is voltage waveforms at various points in the circuit of FIG. 4 when the piezoelectric speaker is driven.

FIG. 6 is the timing chart and voltage waveforms when the piezoelectric speaker 6 is driven. In the graphs the voltage of the battery 1 is $V_E$ and the voltage between the terminals $V_{DD}$ and $V_{SS}$ of the low current system electronic circuit 20 for timekeeping is $V_B$. Waveform $S_1$ is the ON signal for the piezoelectric speaker 6 which is generated automatically in the timekeeping circuit 20, for example, when actual time corresponds with a preselected alarm time. When $S_1$ goes high, the piezoelectric speaker 6 begins to operate. When the piezoelectric speaker driving signal $S_2$ is high, the piezoelectric speaker driving NPN transistor 7 is turned on and a large current flows in the boosting coil 5. When the signal $S_2$ goes high, the power switching signal $S_3$ goes low and the power switching N-channel transistor 25 is turned off and presents a high impedance. Thereby the terminal $V_{SS}$ of the low current electronic circuit 20 for timekeeping is disconnected from the power battery 1. At this time, the electronic circuit 20 for timekeeping is powered by the electrical charge stored in the power capacitor 18 which is positioned directly in parallel across the terminals $V_{DD}$ and $V_{SS}$.

When the signal $S_2$ goes low, the high current to the speaker circuit is turned OFF by making the transistor 7 non-conductive, and battery voltage $V_E$ recovers to the level 15. At the same time, the signal $S_3$ goes high and the power switching N-channel transistor 25 is turned ON such that the power battery 1 and the low current system electronic circuit 20 are again connected to each other. Then the electronic circuit 20 operates directly on the battery 1 and at the same time the capacitor 18 begins to recharge through the transistor 25.

By repeating the above cycle of the signals $S_2$, $S_3$, a voltage $V_B$ (FIG. 6) is provided to the low current system electronic circuit 20 for timekeeping. This voltage $V_B$ falls into a stable pattern achieving the voltage level 15 briefly before each drive cycle of the piezoelectric element. Accordingly, the voltage $V_B$ barely fluctuates even though the battery voltage $V_E$ falls below the minimum operating voltage 16 of the electronic circuit 20. Thus, stable timekeeping is maintained while the speaker is operating.

Similar waveforms are applicable (FIG. 7) when the illumination lamp 8 is driven by a signal S5 which turns the transistor 23 on and off at a suitable repetition rate.

Illumination occurs after the switch 9 is closed to generate a high signal S4. The switch 9 may be actuated by an external member on the case of the timepiece. When the transistor 23 is conductive the lamp is illuminated and a high current is drawn from the battery 1. As the signal S5 goes high to render the transistor 23 conductive, the signal $S_3$ goes low as a result of the NOR gate 31 (FIG. 5), whereby the N-channel transistor 25 becomes non-conductive. Then the timekeeping circuit 20 operates directly from the power capacitor 18 as described above. The signals S2, S3 are derived from an output of the frequency divider (not shown) in the electronic timekeeping circuit 20.

Figure 7:
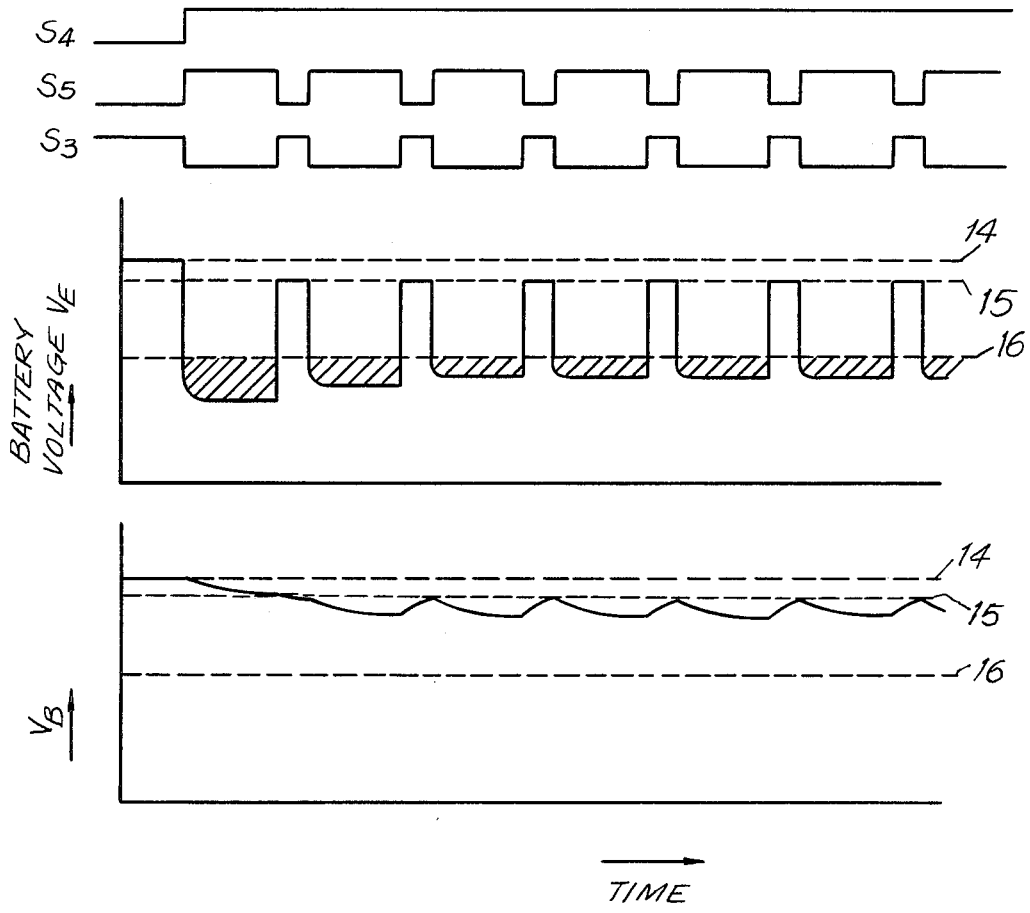
FIG. 7 is voltage waveforms at various points in the circuit of FIG. 4 when an illumination lamp is driven.

As best seen in FIG. 7, the battery voltage $V_E$ falls below the level 16 each time the lamp is lit but the voltage $V_B$ across the electronic circuit 20 for timekeeping never reaches the level 16 where faulty operation of the timekeeping circuits might occur. The repetition rate of the lamp cycle, that is, the frequency of the signal S5 is sufficiently high so as to avoid flicker of the light and the duty cycle of the signal, that is, the ratio of an time to off time can be variable so that the brightness is adjusted. Higher current is drawn on the first cycles of the illumination lamp, producing a greater battery voltage drop until the lamp becomes heated and has increased resistance.

It should be understood that in alternative embodiments in accordance with the invention an electromagnetic speaker may replace the piezoelectric element described above and the illumination lamp may be replaced by another electroluminescent device rather than an incandescent lamp. It should also be understood that in an alternative embodiment in accordance with the invention the power switching transistor 25 may be a P-channel transistor when the terminals $V_{DD}$ and $V_{SS}$ are reversed.

With a power circuit for an electronic timepiece in accordance with the invention as described above, even when the battery voltage falls below the timekeeping circuit operating voltage due to a high current drain on the battery, the fluctuations in the circuit voltage $V_B$ is minimized by interrupting the high current periodically and storing a charge in a power capacitor during the off time of the high current. In addition to improving reliability of operation of the electronic timepiece, the battery lasts longer and the battery can be miniaturized whereby a thin timepiece may be provided. A variety of styling is available for such a thin timepiece.

It will thus be seen that the objects set forth above, among those made apparent from the preceding description, are efficiently attained and, since certain changes may be made in the above construction without departing from the spirit and the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A power circuit for an electronic timepiece, comprising:

a power supply providing a voltage output;

a first load in series with first switch means, said first load and first switch means being connected in series across said power supply, said first load drawing a heavy current from said power supply when said first switch means is closed;

means for placing said first load in an ON state;

a second load and second switch means being connected in series across said power supply, said second load drawing a low current;

a circuit means for periodically opening and closing said first switch means while said first load is in said ON state;

circuit means for periodically opening and closing said second switch means, said second switch means being adapted to open when said first switch means is closed and vice versa;

a power capacitor connected in parallel with said second load, said power capacitor discharging through said second load when said second switch means is open and charging from said power supply through said second switch means when said second switch means is closed, said second load being isolated from said power supply when said first load is activated by closing said first switch means.

2. A power circuit for an electronic timepiece as claimed in claim 1, wherein said second load is a timekeeping function and said first load is one of a loudspeaker and means for illumination.

3. A power circuit for an electronic timepiece as claimed in claims 1 or 2, wherein said first and second switch means are transistors.

4. A power circuit for an electronic timepiece as claimed in claim 2, wherein said timekeeping function includes an oscillator circuit, frequency divider, display driver circuits and a display.

5. A power circuit for an electronic timepiece as claimed in claim 4, wherein said circuit means for periodically opening and closing said first and second switch means operate at a frequency derived from said frequency divider.

6. A power circuit for an electronic timepiece as claimed in claim 5, wherein said means for illumination is an incandescent lamp and said circuit means for periodically opening and closing said switch means operate at a frequency sufficiently high to prevent flicker of said incandescent lamp.

7. A power circuit for an electronic timepiece as claimed in claim 6, wherein the duty cycle of said lamp driving signal is variable to control lamp brightness.

8. A power circuit for an electronic timepiece as claimed in claim 2, wherein said loudspeaker is a piezoelectric speaker element.

9. A power circuit for an electronic timepiece as claimed in claim 1 or 6, wherein said means for placing said first load in said ON state includes an external member.

10. A power circuit for an electronic timepiece as claimed in claim 2, wherein said means for placing said first load in said ON state is triggered by a signal from said timekeeping function.

* * * * *